US007435206B1

(12) United States Patent
Nalley

(10) Patent No.: US 7,435,206 B1
(45) Date of Patent: Oct. 14, 2008

(54) WEIGHT PLATE WITH EXTERNALLY ACTUATED SPRING LOADED INTERNAL LOCKING DEVICE

(76) Inventor: Mark Nalley, 41373 Avenida Delores, Murrieta, CA (US) 92562-7368

( * ) Notice: Subject to any disclaimer, the term of this patent is extended or adjusted under 35 U.S.C. 154(b) by 409 days.

(21) Appl. No.: 10/970,267

(22) Filed: Oct. 22, 2004

(51) Int. Cl.
*A63G 21/00* (2006.01)

(52) U.S. Cl. ..... 482/106; 482/108

(58) Field of Classification Search ..... 482/104–108
See application file for complete search history.

(56) References Cited

U.S. PATENT DOCUMENTS 2,447,218 A * 8/1948 Trzesniewski ..... 482/106
4,601,466 A * 7/1986 Lais ..... 482/98
4,955,603 A * 9/1990 Becker ..... 482/107
5,135,451 A * 8/1992 Chen ..... 482/98
5,417,634 A * 5/1995 Habing ..... 482/99
6,447,430 B1 * 9/2002 Webb et al. ..... 482/98
6,602,169 B1 * 8/2003 Patti ..... 482/107

* cited by examiner

*Primary Examiner*—Jerome Donnelly
(74) *Attorney, Agent, or Firm*—Morland C. Fischer

(57) ABSTRACT

A weight plate for use with physical fitness equipment comprising a plate body with at least a main throughbore and, possibly, other throughbores passing therethrough. The body additionally has an internal bore within the thickness of the plate body which intersects the main central throughbore. A spring loaded selector pin is movably mounted within the internal bore to selectively engage and disengage the plate body to a post positioned in the main throughbore. A handle is mounted to the selector pin externally to the plate to selectively position the selector pin.

12 Claims, 5 Drawing Sheets

WEIGHT PLATE WITH EXTERNALLY ACTUATED SPRING LOADED INTERNAL LOCKING DEVICE

BACKGROUND

1. Field of the Invention

The invention relates to body building equipment, in general, and, more particularly, to a weight plate having an internal, spring-loaded pin which is externally activated to conveniently, safely and simply ease the selection of weight plates in an exercise apparatus.

2. Prior Art

Bodybuilding equipment (also referred to as physical fitness equipment or exercise apparatus) often takes many forms to provide the resistance necessary to tear down muscle tissue during an exercise regime. Contemporarily, many ingenious resistance developing systems or machines have been developed utilizing, for example, systems which incorporate a selectable weight stack. By design, the known equipment allows a user to, within the module, increase weight as the available resistance is incrementally selectable. These systems often promise faster and better results for exercisers. Although history shows the ingenuity of the advancement of mechanical and/or biomechanics may benefit muscle growth, little or no effort has been made to simplify, make safer and contemporize the selectorized weight stack for over four decades.

Conventional weight stacks are, typically, multiple layers of metal-based plates which collectively amass an aggregate amount of weight. Generally, a weight stack includes a variety of rectangular weight plates, typically one inch thick and about 10 by 4 inches. Each conventional plate known in the art incorporates four boreholes therein. Three throughbores pass vertically through the thickness of the plate from the top surface to the bottom surface. The fourth bore passes horizontally from the front face within the width of the plate (between the top and bottom surfaces) and intersects the middle one of the three bore holes.

Two throughbores engage or receive a pair of spaced-apart guide rods and cause the plate to track vertically thereon. The middle throughbore accommodates a center post. The center post has multiple diametric throughbores therein to act as a recipient for a separate selector pin which passes through the fourth throughbore. Thus, each plate may be independently and selectively engaged as part of the weight stack by manually inserting the selector pin which is, typically, slightly longer than the width of a plate and has a knob of sorts on one end so that a user may better manipulate the selector pin. The pin is inserted through the fourth throughbore in the plate and a throughbore in the center post to lock the weight plate to the center post which is then moved when the apparatus is operated.

Although traditional weight stacks, such as those described above, have succeeded in carrying out the intended purpose, there are many areas for substantial improvement.

One key problem often associated with traditional weight stacks is that the selector pin is removable and is often misplaced, stolen or damaged whereupon it is replaced with a functionally and/or structurally inadequately sized pin. This inappropriate replacement historically has caused bodily injury due to the violation of the inherent design of the apparatus.

The removable pin also permits the user to easily modify the operation of the apparatus outside the manufacturer's design criteria for the plates and/or weight stack.

Additionally, there is a level of dexterity and hand-to-eye coordination required to effect the insertion of the selector pin in the horizontal throughbore of the weight and the center post which further limits the true and effective result.

Therefore, the need exists for a more easily manufactured weight plate having a construction that minimizes confusion on the part of the user, possibility for misuse or failure, and the possibility of injury to the user, yet retains the convenient exchange of weight without danger to the user. The weight plate of the present invention satisfies this need.

CO-PENDING APPLICATION

Reference is made to co-pending application entitled WEIGHT PLATE WITH EXTERNALLY ACTUATED INTERNAL LOCKING DEVICE by M. Nalley, filed on Jun. 16, 2004 and bearing Ser. No. 10/868,065.

SUMMARY OF THE INVENTION

The weight plate of the present invention provides a convenient, integrally assembled apparatus for enabling an internal pin to selectively engage or disengage an associated apparatus.

The weight plate includes a plate body with a central and two outwardly throughbores which pass vertically therethrough. The body additionally has an internal horizontal bore which intersects the central vertical throughbore within the thickness of the plate body. A selector pin is movably mounted within the internal horizontal bore to selectively engage the plate body to a center post of the associated apparatus which center post passes through the central throughbore. A positioning sleeve is mounted in the internal bore in the plate to selectively position the selector pin within the internal bore. A spring engages the selector pin to provide a positioning force to the selector pin within the positioning sleeve.

DESCRIPTION OF A PREFERRED EMBODIMENT

Figure 1:
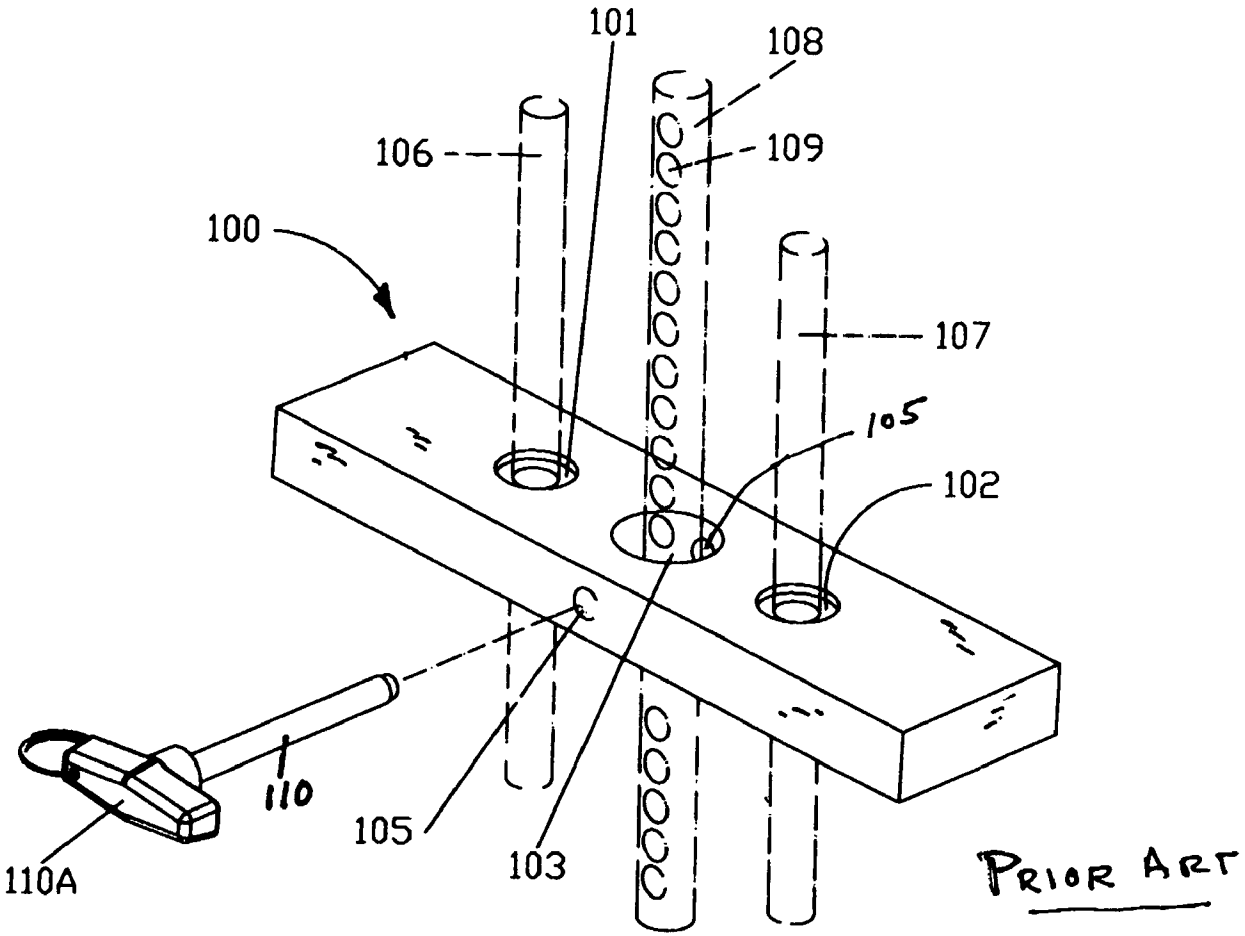
PRIOR ART Fig. 1
FIG. 1 is a partially exploded, perspective view of a weight plate assembly known in the prior art.

Referring now to FIG. 1, there is shown a conventional weight plate 100 which is known in the art. Typically, multiple layers of metal-based plates are used to collectively amass an aggregate gross weight in a weight machine. Generally, a weight plate 100 comprises a rectangular body, typically about one inch thick and about 10 inches by 4 inches. A conventional weight plate 100 incorporates three vertical throughbores 101, 102 and 103 which pass through the thickness of the plate from the top surface to the bottom surface. A fourth throughbore 105 passes horizontally through the width of the plate, i.e., from front to back between the top and bottom surfaces. Throughbore 105 intersects the middle throughbore 103 and passes therethrough into the plate on the other side of throughbore 103.

In a typical utilization, throughbores 101 and 102 engage a pair of spaced apart guide rods 106 and 107 (shown in dashed outline). This arrangement permits the plate 100 to track vertically on the guide rods.

The middle throughbore 103 accommodates a center post 108 also shown in dashed outline. The center post 108 has multiple diametric throughbores 109 to act as a recipient for a selector pin 110 which passes through throughbore 105. Each plate 100 may be independently selected by way of manually inserting the selector pin 110 which is, typically, slightly longer than the front-to-back width of any one plate and has a suitable knob 110A at one end so that a user may better manipulate the pin. The pin is manually inserted through throughbore 105 and a throughbore 109 in the center post 108 (after moving the weights vertically up or down) to select a desired weight plate.

Although conventional weight stacks, such as those described above, have succeeded in carrying out the intended purpose, there are many areas for substantial improvement. For example, the selector pin 110 is frequently misplaced and replaced with a functionally and/or structurally inadequate sized pin. This inappropriate replacement has, historically, let to bodily injury due to the inherent design flaw which permits the freedom of user to openly modify the use of the system outside the manufacturer's intent and/or the plate's (weight stack) design.

Additionally, there is a level of dexterity and hand-to-eye coordination required to effect this "engagement" of the selector pin 110 in the throughbore 105 of the weight plate 100 which further limits usage of the weight system or apparatus.

Figure 2:
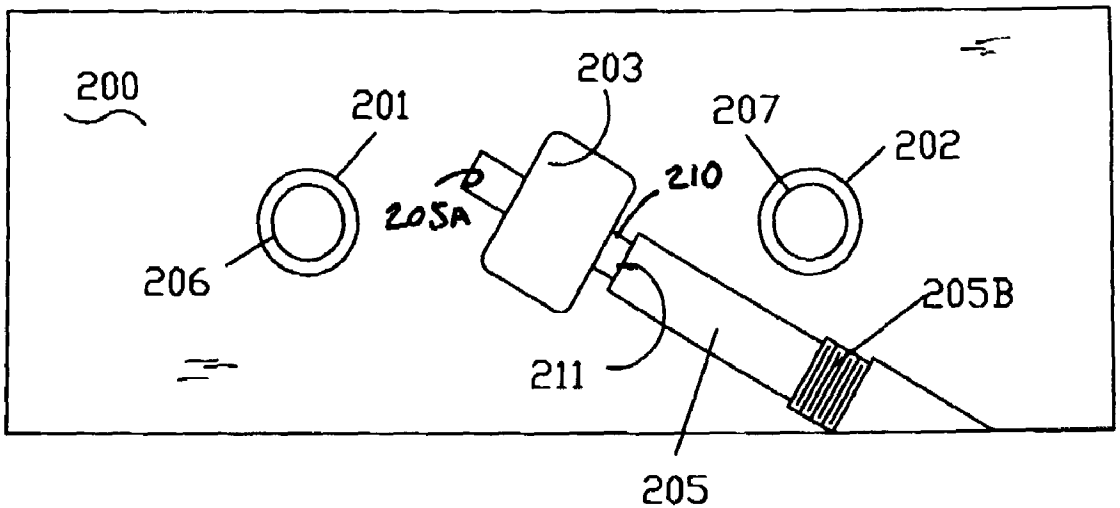
FIG. 2 is a cutaway view of the weight plate apparatus of the instant invention.

Referring now to FIG. 2, there is shown a cutaway view of the selector weight plate 200 of the instant invention. The selector weight plate 200 has the traditional rectangular configuration and is formed from a rigid material, such as iron, steel, urethane, rubber, plastic or a composite material. In order to provide a range of plates having varying weight, the dimensional characteristics of the plate often vary. As an example, a ten-pound weight plate may have a dimension of 10 inches long by 4 inches wide by 1 inch thick. These dimensions are illustrative only and are not limitative. The shape and size of the plate are subject to design preference.

The plate 200 is, typically, similar to the prior art weight plate formed with a middle throughbore 203 so as to accept a pin receiving adjustment bar (see center post 108 in FIG. 1) and two adjacent throughbores 201 and 202 which include low friction type bearings 206 and 207, respectively. Throughbores 201 and 202 receive the vertical guide bars (see bars 106 and 107 in FIG. 1) which stabilize the selected plate.

The plate 200 is further formed with cavity 205 which permits the insertion and movement of the locking pin 701 (see FIGS. 7-9) through the throughbore 203 and the center post 108 into bore end cavity 205A when actuated by the external handle 702. The outer end of cavity 205 is adapted to receive sleeve 300 (see FIG. 4) which is inserted into the plate 200. Cavity 205 includes an internal threaded portion 205B which is adapted to threadedly receive and engage the interior end 305 of sleeve 300.

Figure 3:
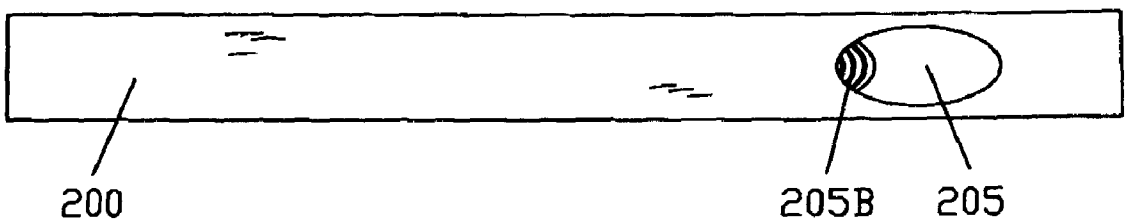
FIG. 3 is a plan view of one side surface of the weight plate apparatus shown in FIG. 2.

Referring now to FIG. 3, there is shown a plan view of one side surface of the weight plate 200 of the instant invention. The plate 200 is formed with internal cavity 205 at the front edge surface which permits the insertion of the pin assembly 700 (see FIG. 7). The cavity 205 communicates with throughbore 203 which houses support post 108. The threaded portion 205B at the surface of cavity 205 is shown. The cavity 205 is properly sized to permit movement of the pin 701 when actuated at the external end thereof. It is understood that the cavity 205 may be formed in any side surface of the plate 300 as may be desired.

Figure 4:
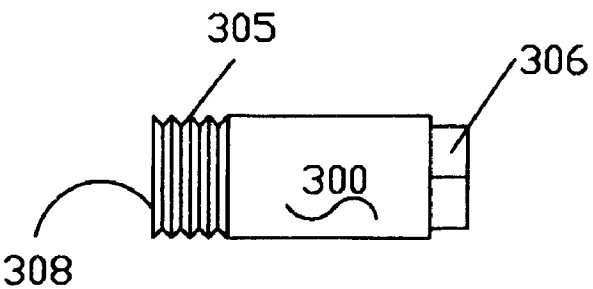
FIG. 4 is an enlarged side view of the positioning sleeve used in the weight plate apparatus of the instant invention.

FIG. 4 is a side view of the sleeve 300 which is generally cylindrical in shape with a threaded portion 305 adjacent end 308 of the cylindrical body. The threaded portion 305 is provided to engage the threaded interior section 205B of cavity 205 in the weight plate (see FIGS. 2 and 3). While not limited thereto, the sleeve 300 is, typically, fabricated of a high strength plastic material.

A generally hexagonal shaped end 306 is formed at the opposite end of sleeve 300. The "hex" shape is generally useful for tightening and securing the threaded engagement of sleeve 300 within the cavity 205 in plate 200 by means of a wrench or the like.

Figure 5:
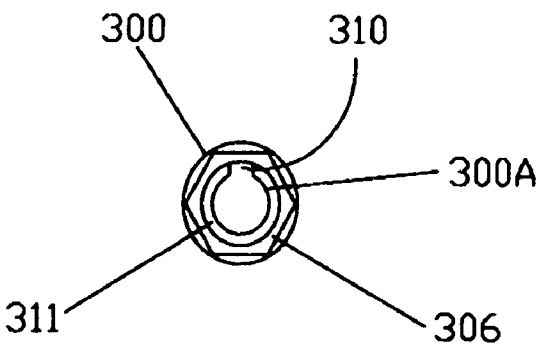
FIG. 5 is an end view of the positioning sleeve shown in FIG. 4.

FIG. 5 is a view of the sleeve 300 from the right end thereof (as shown in FIG. 4). The "hex nut" end 306 is shown. In addition, the end view shows the slot 310 formed in the inner wall 300A of the cylindrical body of sleeve 300. The slot 310 selectively permits sliding travel of retaining pin 711 on engagement pin 701 therethrough (see FIG. 3).

Figure 6:
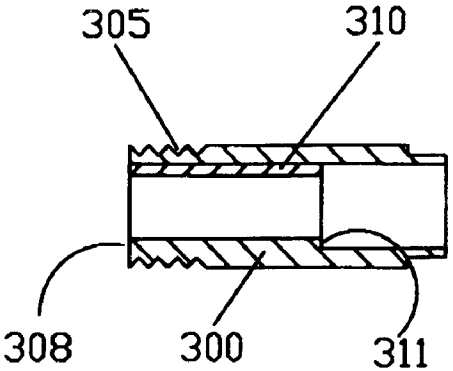
FIG. 6 is a cross-sectional view of the positioning sleeve shown in FIG. 4.

FIG. 6 is a cutaway view of the sleeve 300 which shows the threaded end 305 thereof and the end surface 308. The slot 310 in the inner wall 300A is shown along with the discontinuous ledge 311 which is formed at the outer end of the inner wall 300A.

Figure 7:
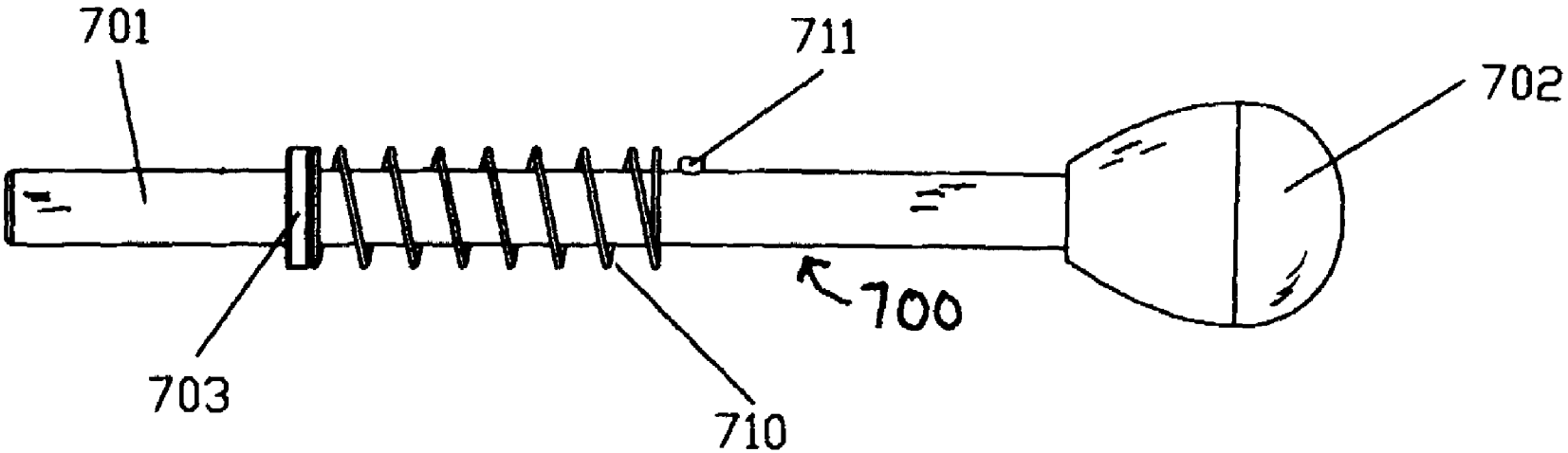
FIG. 7 is a plan view of the locking pin mechanism of the weight plate apparatus of the instant invention.

FIG. 7 is a plan view of the locking pin mechanism 700. The mechanism includes a pin 701 which is, in effect, a rod or shaft formed of a suitably strong material such as but not limitative to steel or the like. The pin 701 is attached to (or integrally formed with) a suitable handle such as knob 702. In a preferred embodiment, the pin 701 is formed of metal and threadedly attached to knob 702 which is manufactured of wood, plastic or the like.

The shaft of pin 701 includes a retainer ring 703 which is swaged, or otherwise fastened, to the pin 701. The retainer ring 703 is properly sized to pass through the main body of cavity 205 but not the outer portion thereof.

In addition, a coil spring 710 encircles the shaft of pin 701 and is engaged by (or seated on) the retainer ring 703.

A retaining pin 711 is formed or otherwise provided at the shaft of pin 701. The retaining pin 711, which may be swaged to the shaft 701, extends radially therefrom. The retaining pin is sized to selectively pass through slot 310 (see FIGS. 5 and 6) and to selectively engage the discontinuous ledge 311 in the sleeve 300.

The weight plate 200 of the instant invention is assembled by forming the plate 200 as shown. The spring 710 is passed over the end of the shaft of pin 701 and into engagement with the retaining ring 703 before the knob 702 is attached to the outer end of the pin.

Likewise, the shaft of the pin 701 is passed through the sleeve 300 from the threaded end 305. The knob 702 is then attached to the shaft of pin 701 thus capturing the spring 710 on the shaft of the pin 701 between the knob 702 and the bottom end 308 of sleeve 300.

The sleeve 300 (with pin 701 therein) is then inserted into cavity 205 through the outer opening in the side wall shown best in FIG. 3. The threaded end 305 of sleeve 300 is then threadedly engaged with the threaded portion 205A of cavity 205. The sleeve 300 is snugly secured by means of a wrench or the like applied at the hex end 306 of the sleeve.

Figure 8:
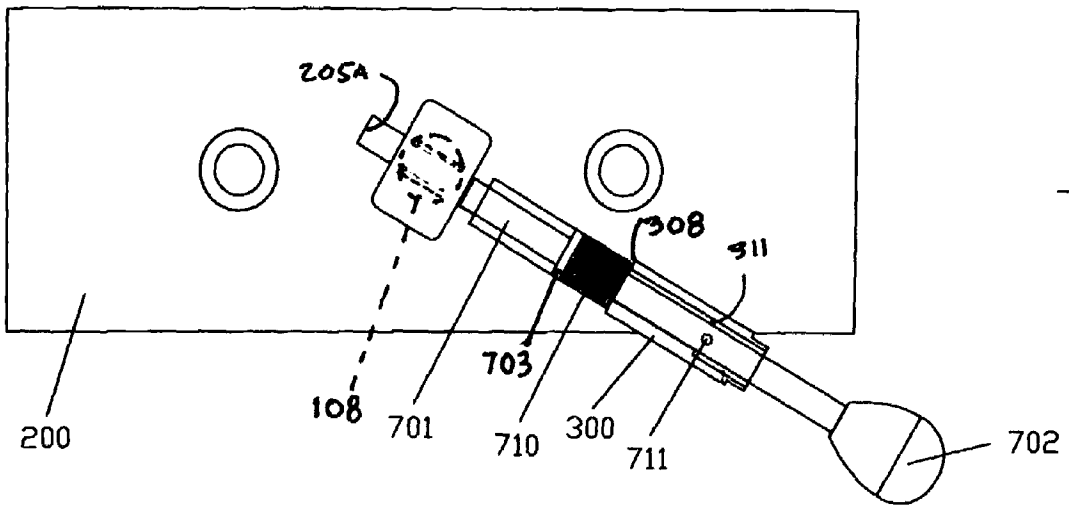
FIG. 8 is a cutaway view of the weight plate apparatus in the engaged position.

FIG. 8 shows a cutaway view of the weight plate 200 in the unlocked (or disengaged) position relative to the support post 108. That is, the pin 701 is, effectively, stored in the cavity 205.

To store the pin 701 (or to release the pin 701 from engagement with the support post 108), the knob 702 is rotated until the retaining pin 711 is aligned with slot 310 in sleeve 300. The knob 702 is pulled outwardly along with pin 701 which passes through the sleeve 300 thereby compressing spring 710 between ring 703 and the inner end 308 of sleeve 300. When the pin 701 (with the retaining pin 711) has passed through the central aperture in the sleeve, the pin 701 is rotated so that the retaining pin 711 is out of alignment with slot 310. The retaining pin 711 is locked against the inner ledge 311 at the outer end of sleeve 300. At this point the pin 701 is disengaged from post 108 and the weight plate 200 can be added to or removed therefrom.

Figure 9:
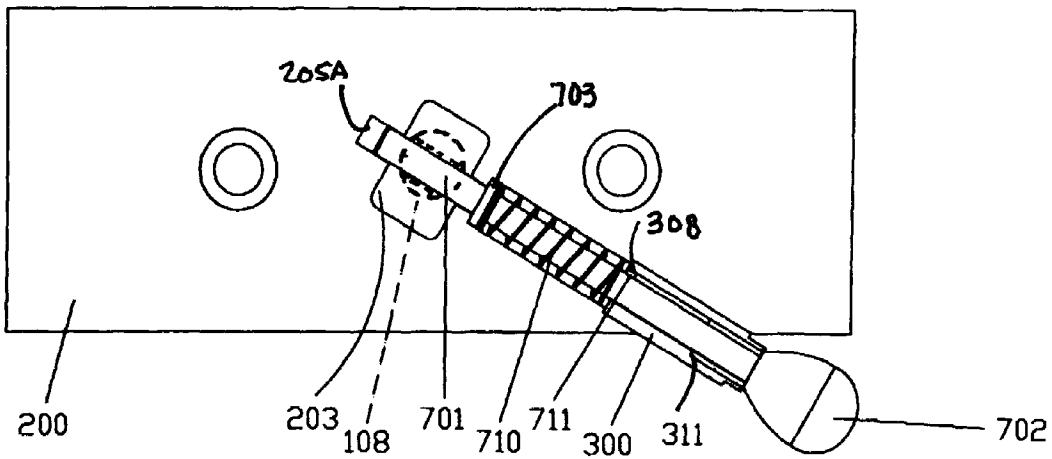
FIG. 9 is a cutaway view of the weight plate apparatus in the disengaged position.

FIG. 9 shows a cutaway view of the weight plate 200 with the pin 701 in the locked position relative to the support post 108. In order to lock the weight plate 200 to the center post 108, the knob 702 (and attached pin 701) is rotated thereby aligning the retaining pin 711 with the slot 310 in sleeve 300 whereupon the spring 710, compressed between sleeve end 308 and retainer ring 703, is able to force the pin 701 inwardly into bore end 205A via the diametric throughbore in support post 108 within throughbore 203. The spring 710 maintains the pin 701 in the locked position and engages the plate to the support port until the pin 701 is released as discussed relative to FIG. 8.

Thus, it is noted that the locking mechanism remains with the weight plate but is readily accessed outside the dimensions of the plate for safety. Those skilled in the art will appreciate the many benefits and advantages afforded the present invention. Of significant importance is the ability to easily and safely select weight with a single finger while maintaining the advantage of providing an integrally formed and uniform system to reduce cost and liability exposure to the consumer.

While the invention has been particularly shown and described with reference to the preferred embodiments thereof, it will be understood by those skilled in the art that various changes in form and detail may be made therein without departing from the spirit and scope of the invention.

Thus, there is shown and described a unique design and concept of a weight plate with externally actuated spring loaded internal locking device. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A weight plate for physical fitness equipment including, a weight plate body formed with at least a first bore passing vertically through said weight plate body, an internal bore formed horizontally within said weight plate body and communicating with said first bore, a sleeve mounted within said internal bore in said weight plate body, an engagement pin movably mounted within said sleeve in said internal bore in said weight plate body, said engagement pin including a retaining pin extending radially therefrom, and said sleeve including a slot therein for selectively passing said retaining pin therethrough, a spring adapted to selectively move said engagement pin within said internal bore and through said first bore, and a handle attached to said engagement pin to move said engagement pin within said internal bore to remove said engagement pin from said first bore.

2. The weight plate recited in claim 1 including, a retainer ring formed on said engagement pin for retaining said spring within said internal bore.

3. The weight plate recited in claim 1 wherein, said weight plate body is formed of a metallic material.

4. The weight plate recited in claim 1 wherein, said handle extends outwardly from said weight plate body so that said handle may actuate said engagement pin to be selectively positioned within said first bore in said weight plate body.

5. The weight plate recited in claim 1 wherein, said plate body is rectilinear in shape.

6. The weight plate recited in claim 1 wherein, said sleeve is threadedly engaged with an internal surface of said internal bore.

7. A weight plate apparatus including, a rectilinear weight plate formed with an internal cavity, an engagement pin slidably mounted within said cavity in said weight plate so that said engagement pin may be operated by an external handle such that said engagement pin provides a positive control internal mechanical locking system integrally formed within said weight plate, and a sleeve for receiving said engagement pin threadedly engaged with an internal surface of said weight plate, said engagement pin including a retaining pin extending radially therefrom, and said sleeve including a slot therein for selectively passing said retaining pin therethrough.

8. The apparatus recited in claim 7 wherein, said cavity is sized for slidable receipt of said engagement pin.

9. The weight plate recited in claim 7 wherein, said external handle extends outwardly from said weight plate body so that said handle may actuate said engagement pin to be selectively positioned within said cavity in said weight plate body.

10. A weight plate for physical fitness equipment including, a rectilinear plate body formed with at last a first bore passing vertically through said plate body in order to receive a lift post, an internal bore formed horizontally within said plate body and intersecting with said first bore, an engagement pin movably mounted within said internal bore, a sleeve threadedly mounted in said internal bore to receive said engagement pin slidably therethrough, said engagement pin including a retaining pin extending radially therefrom to engage a shoulder in said sleeve, and said sleeve including a slot in the shoulder thereof for selectively passing said retaining pin therethrough, a spring mounted on said engagement pin and adapted to selectively move said engagement pin within said internal bore and through said first bore to selectively engage a lift post, and a handle attached to said engagement pin external to said plate body to permit said engagement pin to be selectively moved within said internal bore away from said first bore and out of engagement with a lift post.

11. The weight plate recited in claim 10 including, a retainer ring formed adjacent one end of said engagement pin for retaining said spring on said engagement pin and within said internal bore.

12. The weight plate recited in claim 10 wherein, said body is formed of a metallic material.

* * * * *